United States Patent [19]

Honda et al.

[11] Patent Number: 4,908,485

[45] Date of Patent: Mar. 13, 1990

[54] PUSH-BUTTON SWITCH

[75] Inventors: Sueaki Honda, Uji; Mitsuji Hayashi, Nagaokakyo; Yasuhiro Kiyono, Nagaokakyo; Takashi Niwa, Nagaokakyo; Tomohiko Hayakawa, Fushimi, all of Japan

[73] Assignee: Omron Tateisi Electronics Co., Shimokaiinji, Japan

[21] Appl. No.: 293,587

[22] Filed: Jan. 4, 1989

Related U.S. Application Data

[63] Continuation of Ser. No. 82,950, Aug. 5, 1987, abandoned, which is a continuation of Ser. No. 714,667, Mar. 22, 1985, abandoned.

[30] Foreign Application Priority Data

| | | | |
|---|---|---|---|
| Mar. 22, 1984 | [JP] | Japan | 59-41246 |
| Mar. 28, 1984 | [JP] | Japan | 59-61824 |
| Mar. 29, 1984 | [JP] | Japan | 59-62598 |
| Mar. 30, 1984 | [JP] | Japan | 59-63918 |
| Apr. 2, 1984 | [JP] | Japan | 59-45856 |
| Apr. 2, 1984 | [JP] | Japan | 59-48780 |
| Apr. 3, 1984 | [JP] | Japan | 59-49328 |
| Apr. 3, 1984 | [JP] | Japan | 59-49329 |

[51] Int. Cl.[4] ..... H01H 9/16; H01H 3/12

[52] U.S. Cl. ..... 200/462; 200/283; 200/314; 200/467; 200/526

[58] Field of Search ..... 74/100 R, 100 D, 99 R; 200/462–467, 526, 314, 302.2, 293, 296, 283

[56] References Cited

U.S. PATENT DOCUMENTS

| | | | |
|---|---|---|---|
| 3,030,465 | 4/1962 | Roeser | 200/463 |
| 3,105,887 | 10/1958 | Korsgren et al. | 200/451 |
| 3,432,632 | 3/1969 | Schenke | 200/463 |
| 3,691,333 | 9/1972 | Elliott | 200/526 |
| 3,764,761 | 10/1973 | Poltorak et al. | 200/447 |
| 4,242,545 | 12/1980 | Schweitzer | 200/314 |
| 4,268,735 | 5/1981 | Iwakiri | 200/314 |
| 4,350,857 | 9/1982 | Fillus et al. | 200/314 |
| 4,354,078 | 10/1982 | Yoshimura | 200/314 |
| 4,374,373 | 2/1983 | Kurz | 200/465 |
| 4,431,879 | 2/1984 | Fujita et al. | 200/314 |
| 4,447,685 | 5/1984 | Ohashi et al. | 200/439 |
| 4,453,059 | 6/1984 | Fukushima | 200/296 |
| 4,495,391 | 1/1985 | Kitao et al. | 200/526 |
| 4,496,813 | 1/1985 | Fukushima | 200/314 |
| 4,673,778 | 6/1987 | Lewandowski | 200/467 |

FOREIGN PATENT DOCUMENTS

| | | | |
|---|---|---|---|
| 1490029 | 11/1969 | Fed. Rep. of Germany . | |
| 2914709 | 10/1980 | Fed. Rep. of Germany | 200/314 |
| 2108765 | 11/1981 | United Kingdom . | |

*Primary Examiner*—Ernest G. Cusick

*Attorney, Agent, or Firm*—Wegner & Bretschneider

[57] ABSTRACT

A switch in which a switch unit is constituted by situating the free end of a first movable member disposed with a contact between stationary contacts opposing to each other along the vertical direction, while engaging the other end of the movable member to a fixed portion, pivoting one end of a second movable member to the free end of the first movable member while engaging a spring to the other end of the s econd movable member, thereby biasing the contact of the first movable member to one of the stationary contacts, and setting the other end of the second movable member to a switch operation portion, as well as a switch wherein a housing, which enhouses a push button unit containing an illumination unit, a socket unit to be connected to the illumination unit and a plunger to be connected to the push button switch, contains to secure the switch mechanism at the lower opening thereof and the lower end of the plunger is disposed to the switch operation portion.

19 Claims, 15 Drawing Sheets

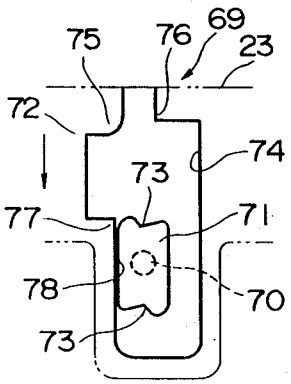
FIG. 7(a)
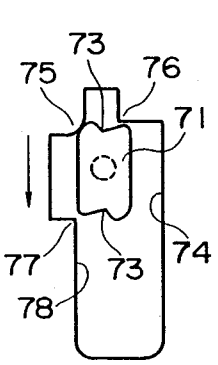
FIG. 7(b)
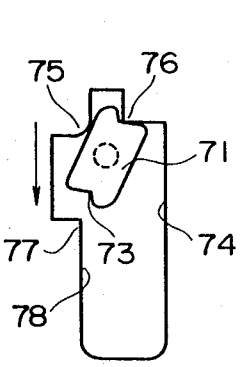
FIG. 7(c)
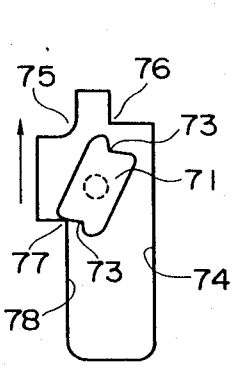
FIG. 7(d)
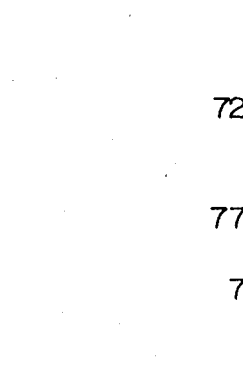
FIG. 7(e)
FIG. 7(f)
FIG. 7(g)
FIG. 7(h)

PUSH-BUTTON SWITCH

This application is a continuation of U.S. application Ser. No. 082,950, filed Aug. 5, 1987, now abandoned, which is a continuation of U.S. application Ser. No. 714,667, filed Mar. 22, 1985, now abandoned.

FIELD OF THE INVENTION

This invention concerns a switch for use in various types of electronic equipments and, more specifically, it relates to a switch actuated by the depressing operation of a push button.

BACKGROUND OF THE INVENTION

As the general contact structure for the above-mentioned switch, the structure as shown in FIG. 20 has been known.

Specifically between the inner space are a switch cover 201 and a switch base 202 oppositely arranged from to each other vertically, an upper terminal 203 and a lower terminal 204 are oppositely arranged one above the other with a predetermined gap, and contacts 205, 206 are secured to the opposing faces of both of the terminals 203, 204 respectively.

A common terminal 207 is disposed vertically on one side of the contacts 205, 206, in which the base end of a first movable member 208 is engaged to the lower portion of the common terminal 207 while the free end of the first movable member 208 is situated in the vicinity of the contacts 205, 206 of the above-mentioned upper and lower terminals 203, 204.

A second movable member 209 inserted between the contacts 205, 206 is engaged at one end thereof to the free end of the first movable member 208, and the second movable member 209 has contacts 210, 210 secured at the positions corresponding to the contacts 205, 206 respectively. Further, a spring 211 is stretched between the outer end of the second movable member 209 and the common terminal 207, so that the contact 210 on the second movable member 209 is always biased to be in contact with the contact 206 on the lower terminal 204.

An operation member 212 undergoing the depressing operation is supported above the free end of the second movable member 209. When the operation member 212 is depressed, the free end of the second movable member 209 moves downwardly to switch the contact 210 of the second movable member 209 from the contact 206 on the lower terminal 204 to the contact 205 on the upper terminal 203.

The contact structures having been constituted as described above have the following problems.

Namely, upon switching the second movable member 209, the second movable member 209 is slanted largely corresponding to the amount of depression of the operation member 212 to result in a slip, due to the slanting, between the contact 210 of the second movable member 209 and the contact 206 on the lower terminal 204 in a partially contacted state, as well as a similar slippage for the contact between the contact 205 on the upper terminal 203 and the contact 210 of the second movable member 205 after switching operation.

If the slipping contact is acted between the contacts 206, 210 and between the contacts 205, 210, the contact faces are abraded to roughen the contact faces thereby resulting in malcontact, reduction in the switch operation characteristic and, thus, reduction in the switch life.

SUMMARY OF THE INVENTION

This invention concerns a switch in which a switch unit is constituted by situating the free end of a first movable member disposed with a contact between stationary contacts opposed to each other along the vertical direction, while engaging the other end of the movable member to a fixed portion, pivoting one end of a second movable member to the free end of the first movable member while engaging a spring to the other end of the second movable member, thereby biasing the contact of the first movable member to one of the stationary contacts, and setting the other end of the second movable member to a switch operation portion. The invention further concerns a switch wherein a housing, which encloses a push button unit containing an illumination unit, a socket unit to be connected to the illumination unit and a plunger to be connected to the push button switch, secures the switch mechanism at the lower opening thereof and the lower end of the plunger is disposed to the switch operation portion.

OBJECT OF THE INVENTION

The first object of this invention is to provide a switch free from malfunctions in the contacts and reduction in the switch operation characteristic. by preventing the surface of the contacts from being roughened.

The second object is to provide an effective double-throwing or multiple-throwing type switch.

The third object is to provide a push button and illumination type push button switch which can be assembled easily.

The fourth object is to provide a switch in which an alternating mechanism for holding the depressing operation position of the push button is arranged effectively.

The fifth object is to provide a switch capable of preventing external dust or the like from intruding to the inside by an effective sealing mechanism, when constituted as a push button switch.

The sixth object is to provide a switch in which the depressing operation of the push button is disabled and the push button can be used as a display means, when constituted as an illumination type push button.

The seventh object is to provide a switch capable of obtaining an effective connection for illumination elements contained in a push button, when constituted as an illumination type push button switch.

The eighth object is to provide a switch capable of alternatively selecting the mounting structure to an operation panel between the securing using a nut and securing using a resilient member, when constituted as a push button switch.

The ninth object is to provide an effective socket for electrical connection with a switch, when constituted as a push button switch or an illumination type push button switch.

BRIEF DESCRIPTION OF THE DRAWINGS

The drawings show one embodiment according to this invention, wherein

FIGS. 7*a*–7*h* are explanatory views showing the operation state of the alternating mechanism.

EMBODIMENT OF THE INVENTION

Figure 1:
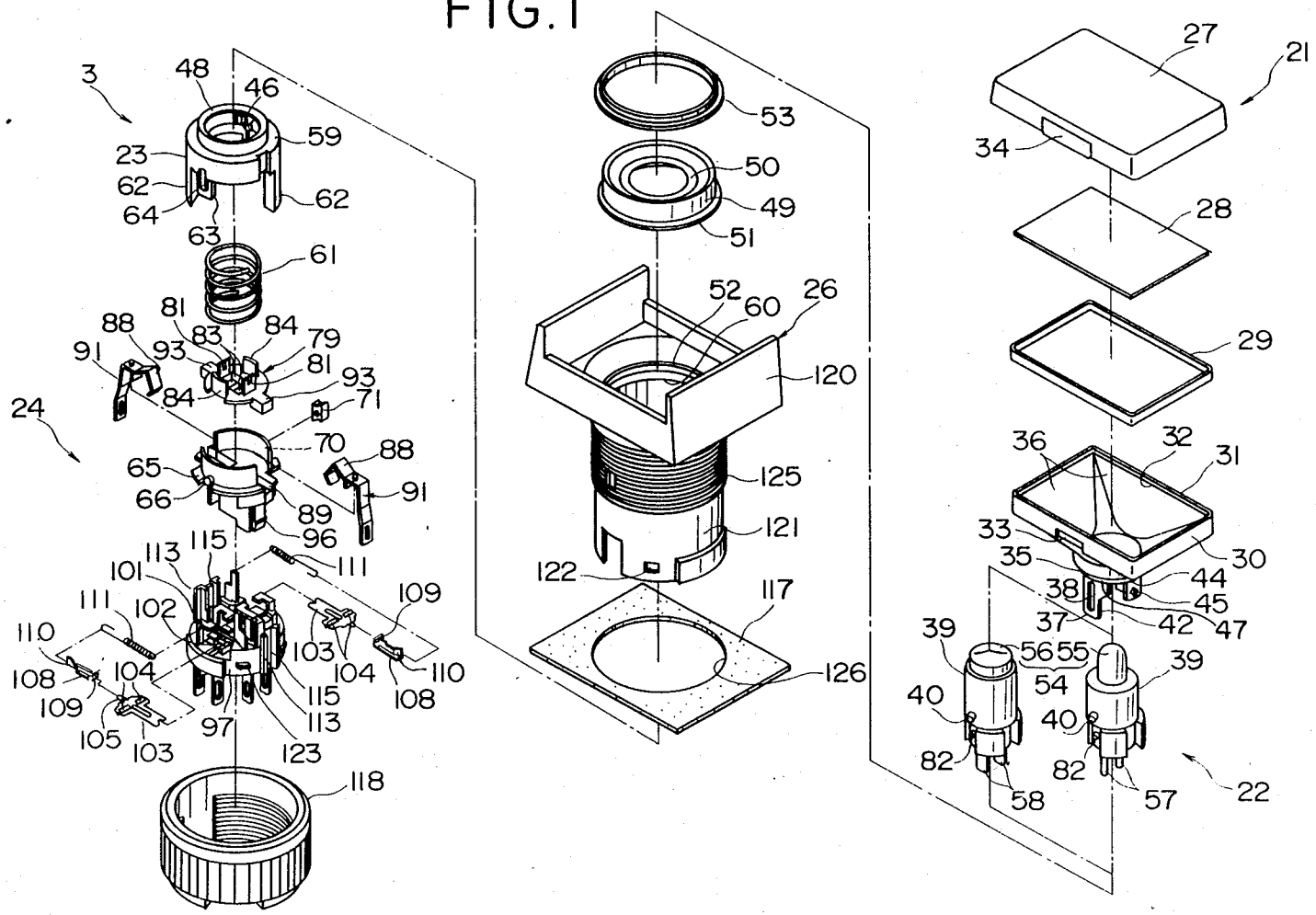
FIG. 1 is an exploded perspective view for an illumination type push button switch.

This invention will now be described more specifically by way of its preferred embodiment referring to the drawings.

The drawings show an illumination type push button switch in which a push button is illuminated.

Figure 2:
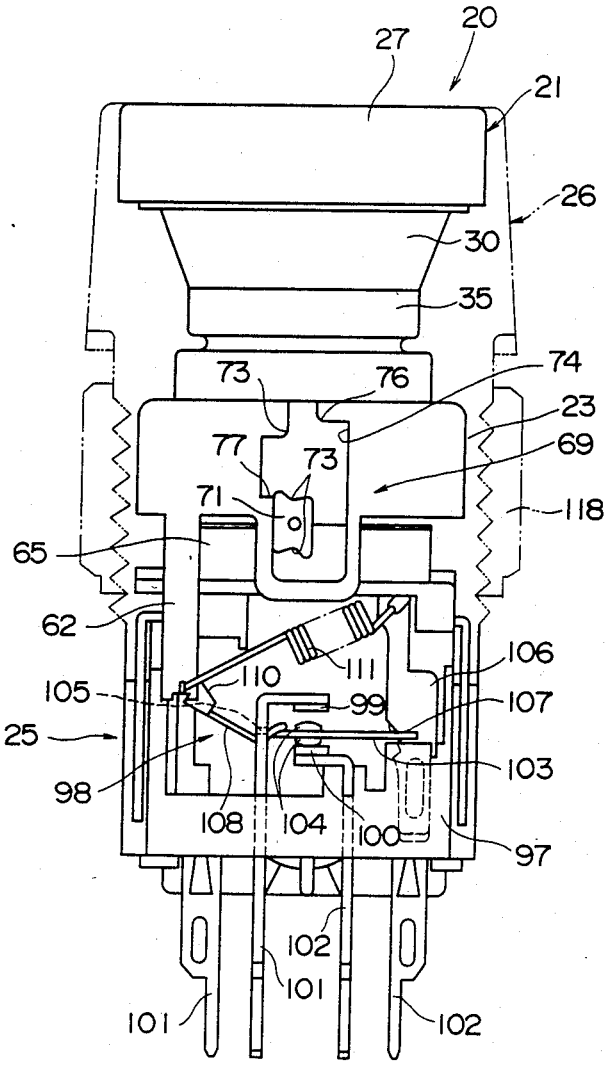
FIG. 2 is a side elevational view for the illumination type push button switch.
Figure 3:
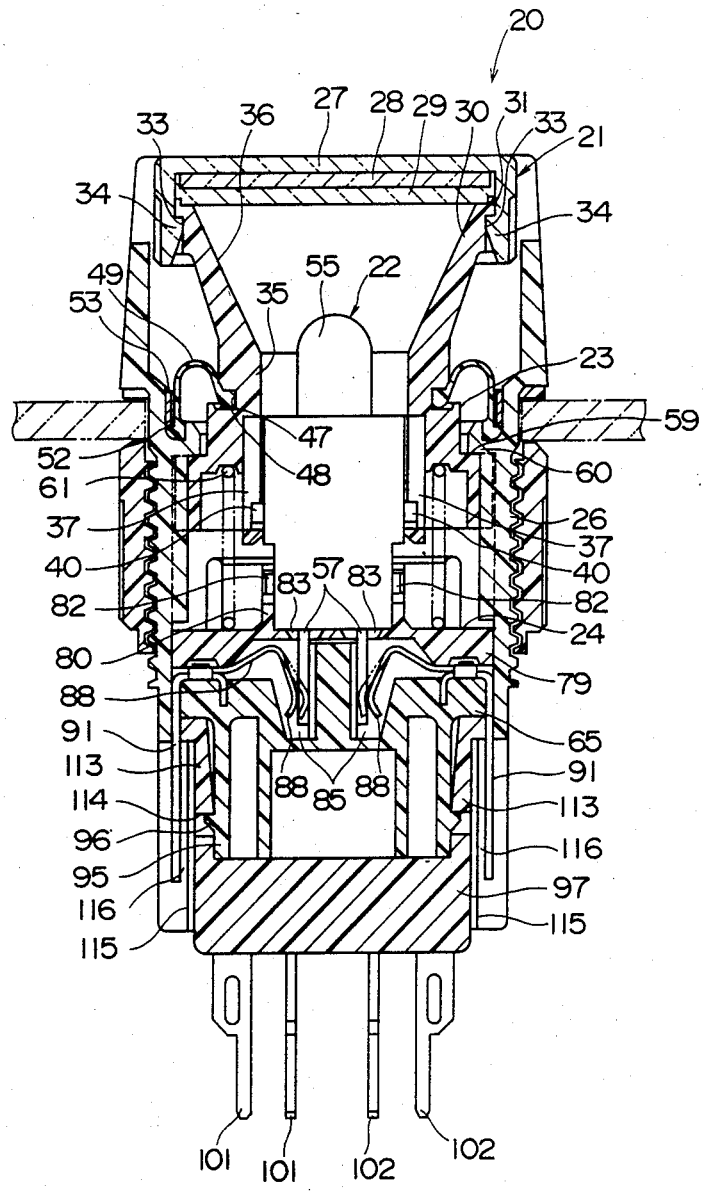
FIG. 3 is a vertical cross sectional view for the illumination type push button switch.

As shown in FIGS. 1, 2 and 3, an illumination type push button switch 20 comprises a push button unit 21 for switching operation, an illumination unit 22 for illuminating the illumination face, a plunger 23 for transmitting the downward movement of the push button unit 21, a socket unit 24 for the electrical connection of the illumination unit 22, a switch unit 25 actuated by the depression of the plunger 23, and a housing 26 for enclosing each of the elements 21–25.

(a) Description of the Push Button Unit

The push button unit 21 is constituted as described below.

Specifically, a rectangular box-like push button 27 optionally pigmented with red, yellow, green or like other color and open at the bottom contains in the inside thereof a generally rectangular plate 28 attached with a mark for indicating the switching function and a rectangular diffusion plate 29 for diffusing light. The upper illumination face of the push button 27 is illuminated by the illumination unit (described below). A reflection member 30 is inserted fittingly therebelow.

The diffusion plate 29 is recessed at the top surface thereof and the plate 28 is fitted to the recess.

The reflection member 30 has a rectangular peripheral edge 31 formed at the upper end thereof capable of fitting the lower opening of the push button 27. A step 32 is formed to the inside of the peripheral edge 31, to which diffusion plate 29 is fitted at the lower surface thereof.

Engagements 33, 33 are formed stepwise at the two opposing positions on the outer circumferential surface of the peripheral edge 31 of the reflection member 30, and engaging protrusions 34, 34 are formed to the inner wall of the bottom opening of the push button 27 corresponding to the engagements 33, 33, so that upon fitting of the reflection member 30 to the opening, the engagements 33, 33 and the engaging protrusions 34, 34 are engaged with each other to integrally secure the push button 27, the mark plate 28, the diffusion plate 29 and the reflection member 30.

The circumferential surface of the reflection member 30 is restricted from the upper to the lower portions as a frusto pyramidal shape, in which the central portion constitutes a cylindrical portion 35. The inner peripheral surface of reflection member 30 constitutes a reflection surface 36 slanted toward the central portion, the reflection surface 36 reflecting light from the illumination element contained in the cylindrical portion 35 upwardly.

The cylindrical portion 35 of the reflection member 30 is equipped with a structure for supporting the illumination unit 22 and a structure for regulating the direction of containment of the illumination unit 22.

Specifically, supports 37, 37 are suspended from opposing portions of the cylindrical portion 35 of the reflection member 30. Supports 37, 37 have elongate grooves 38, 38 each of a length corresponding to the depressing stroke of the push button unit 21.

The illumination unit 22 contained within the opening of the cylindrical portion 35 has protrusions 40 formed at the side of an element holder 39 thereof which fit in elongate grooves 38.

Further, protrusions 41, 41 which can impinge on the supports 37, 37 are arranged at the lower outer periphery of the element holder 39.

The support 37 has a notch 42 formed at one side edge thereof and an abutment 43 at the lower end thereof, which act as described below.

Figure 4:
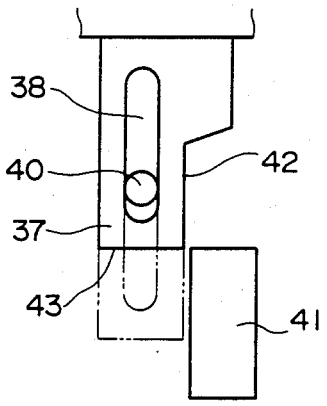
FIG. 4 is a side elevational view for a portion of the switch showing the mounting state of an illumination unit to a push button unit.

As shown in FIG. 4, the notch 42 allows the protrusion 41 to be inserted therethrough when the protrusion 40 of the element holder 39 is fitted in the elongate groove 38 of the support 37 in the direction of insertion of the illumination unit 22 into the push button unit 21. In this situation, switch 20 serves as an illumination type push button switch.

Figure 5:
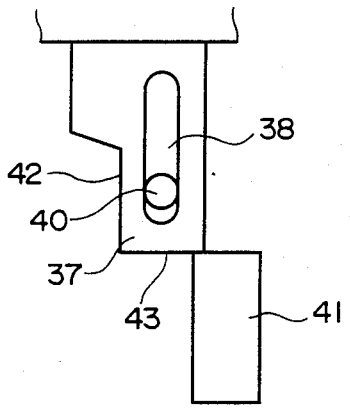
FIG. 5 is a side elevational view for a portion of the switch showing the mounting state of the illumination unit to the push button unit when it is reversed.

Further, as shown in FIG. 5, by rotating the illumination unit 22 by 180° the lower surface 43 of the support 37 abuts against the upper surface of the protrusion 41 of the element holder 39 and inhibits the insertion of the protrusion 41 when the protrusion 40 of the element holder 39 is engaged in the elongate groove 38 of the support 37. Thus, the depression operation of the push button is disabled, and the illumination unit 22 serves as a display device.

By the operation as described above, the direction of insertion of the illumination unit 22 is regulated to a predetermined direction and, by supporting the illumination unit 22 on the supports 37, 37, assembling work for the push button unit 21 and the illumination unit 22 is facilitated.

The cylindrical portion 35 of the reflection member 30 is equipped with a structure for connecting the plunger 23.

Specifically, engaging fingers 44, 44 are suspended at opposing portions of the cylindrical portion 35 displaced 90 degrees from the positions for the supports 37, 37, and the engaging fingers 44, 44 are formed with seizing grooves 45, 45 which are open at the lower ends.

The plunger 23 is cylindrically shaped protrusions 46, 46 formed on the inner wall surface of the upper end thereof at the positions opposing to the engaging fingers 44, 44. The protrusions 46, 46 are engaged and put between the seizing grooves 45, 45 in the engaging fingers 44, 44 of the reflection member when the reflection member 30 and the plunger 23 are joined, by which the reflection member 30 and the plunger 23 are connected.

Further, by the above-mentioned connection, the depressing operation of the push button unit 21 is transmitted to the plunger 23.

Between the cylindrical portion 35 of the reflection member 30 and the inner wall surface of the housing 26 is formed a seal structure.

Specifically, a step 47 is formed at the outer circumferential edge of the cylindrical portion 35 of the reflection member 30, while a step 48 is formed also at the upper end edge of the plunger 23 corresponding to the step 47, and an annular engaging groove is formed by joining both of the steps 47, 48.

The seal 49 is molded of resilient material into a circular shape surrounding the periphery. The inner end edge 50 of the seal 49 is thicker than the space of the engaging groove formed by the steps 47, 48. When the steps 47, 48 are joined, the inner end edge 50 is put therebetween and, when the inner end edge 50 is fitted to the engaging groove defined by steps 47, 48, it is seized and held by the engaging groove.

The outer peripheral edge 51 of the seal 49 is fitted to an annular groove 52 formed to the inner wall surface of the housing 26, and an annular fixing ring 53 is fitted over the upper portion of the annular groove 52 to secure the outer end edge 51 to the annular groove 52.

The seal 49 prevents external dust or the like from intruding to the inside.

The upper end of the housing 26 is shaped into a rectangular box-like configuration so that the push button unit 21 constituted as described above may be fitted. The central portion is generally configured like a cylindrical shape so that the cylindrical plunger 23 may be mounted.

(b) Description of the Illumination Unit

The illumination unit 22 comprises an illumination element 54 and the element holder 39 as described above, and the illumination element 54 includes two types, that is, a lamp 22 and a LED 56, which are respectively fitted to the element holder 39 and selected upon use depending on the purpose of use.

Lead terminals 57, 57 of the lamp 55 are generally configured like solid cylinders and lead terminals 58, 58 of the LED 56 are in a plate-like shape. The plate-like lead terminals 58, 58 are formed somewhat thinner than the round rod-like lead terminals 57, 57.

The illumination unit 22 having thus been constituted is housed within and engaged to the cylindrical portion 35 at the lower end of the push button unit 21.

(c) Description of the Plunger

The plunger 23 is of cylindrical configuration and has at the upper end edge thereof a reduced diameter step 59, which abuts against a flange 60 formed at the upper end edge of the cylindrical inner wall of the housing 26, thereby being prevented from slipping off when the plunger 23 is inserted from the lower end opening of the housing 26.

Further, a returning spring 61 is housed within to the inside of the plunger 23 and the spring 61 resiliently biases the plunger 23 upwardly by abutting inside the plunger 23 against the upper surface of the socket unit.

Two operation members 62 and a control member 63 are suspended from the lower peripheral edge of the plunger 23.

Each operation member 62 opposes a switch operation portion of the switch unit 25 to perform switching operation upon depression of the plunger 23.

The control member 63 is formed with an elongate groove 64 of a length corresponding to the depressing stroke of the push button unit 21. The elongate groove 64 is engaged with a protrusion 66 disposed on the side of the socket base 65 to control the depression stroke of the plunger 23, as well as control the rotation of the plunger 23.

The inner circumferential wall surface at the upper end opening of the plunger 23 is disposed with a control structure for controlling the direction of inserting the illumination unit 22 to one direction.

Figure 6:
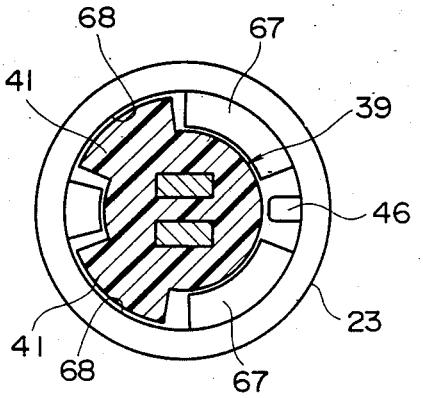
FIG. 6 is a transversal cross sectional view for a element holder portion of the illumination unit.
Figure 8:
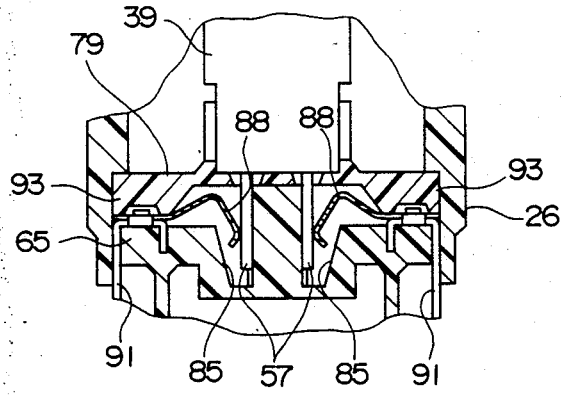
FIG. 8 is a vertical cross sectional view for a socket unit portion.
Figure 9:
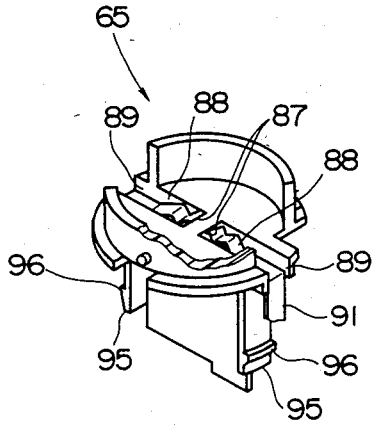
FIG. 9 is a partially cut-away perspective view for a socket base.

As shown also in FIG. 6, protrusions 67, 67 protrude from at the inner circumferential wall surface of the upper end opening of the plunger 23 to thereby form grooves 68 between each of the protrusions 67, 67.

The protrusions 67, 67 and the grooves 68 allow insertion of the protrusions 41, 41 of the illumination unit 22, and, when the illumination unit 22 is inserted at 180° rotation, the protrusions 67, 67 are abutted against the protrusions 41, 41 to inhibit the insertion of the illumination unit 22 therethrough.

Since the direction of inserting the illumination unit 22 is control to a predetermined direction by the above-mentioned regulation structure, an erroneous insertion can be prevented, for example, in a case of using the LED 56 having a polarity as the illumination element 54.

An alternating mechanism 69 is formed between the socket unit 24 of the plunger 23 and the socket base 65 of the socket unit 24.

As shown in FIGS. 2 and 7, the alternating mechanism 69 comprises an alternating cam 71 pivoted on the shaft 70 at the outer wall surface from the socket base 65, and a cam control portion 72 formed in the wall surface of a plunger 23 opposing the cam 71.

The cam 71 is in a rectangular shape and has engaging grooves 73, 73 formed on two opposing shorter sides.

The cam control section 72 is defined by forming a window 74 in the wall surface of the plunger 23, in which four control sections 75, 76, 77, 78 are formed on the peripheral edge of the window 74.

The first control section 75 is defined by forming an arcuate corner on one upper side of the window 74. When the cam 71 abuts against the first control section 75, the cam 71 is rotated in one direction by a predetermined angle.

The second control section 76 is defined by forming a corner at a position somewhat higher than that for the control section 75 at the other upper end of the window 74. The second control section 76 controls the rotating position of the cam 71 rotated by a predetermined amount by the above-mentioned first control section 75 by engaging with the engaging groove 73 situated at the upper end of the cam 71.

The third control section 77 is defined by forming a corner on one side of the middle portion of the window 74. It controls the position of the plunger 23 at the switch operation position by engaging the engaging groove 73 situated at the lower end of the cam 71, the position of which is controlled by the second control section 76.

The fourth control section 78 is defined with a vertical face formed on one side of the lower portion of the window 74, and it holds the rotating state of the cam 71 which has been rotated by one-half upon successive downward movement and the subsequent returning of the plunger 23.

The alternating mechanism 69 having thus been constituted is operated as shown in FIGS. *7a–7h*.

Specifically, the plunger 23 is situated above and the switch is put to OFF in the state shown in FIG. *7a*.

When the plunger 23 is depressed from the off state, the plunger 23 is moved downwardly, in which the first control section 75 abuts against the upper one corner of the cam 71 to rotate the cam 71 clockwise as shown in FIG. *7b*.

Further, when the plunger 23 is moved downwardly, the second control section 76 engages with the engaging groove 73 at the upper end of the cam 71 to stop the rotation of the cam 71 and control the position thereof as shown in FIG. *7c*.

Then, when the depressing operation of the plunger 23 is released, since the plunger 23 is moved upwardly by the spring 61, the third control section 77 abuts against the lower one corner of the cam 71 to slightly rotate the cam 71 clockwise as shown in FIG. *7d*.

Then, as shown in FIG. *7e*, the third control section 77 engages the engaging groove 73 at the lower end to stop the upward movement of the plunger 23. That is, the plunger 23 is locked at that position, where the switch is operated to ON and locked at the ON state.

Then, in order to release the locked state as described above, the plunger 23 is depressed again. Upon this depressing operation, the plunger 23 moves somewhat downwardly.

As shown in FIG. *7f*, since the second control section 76 abuts against one corner of the cam 71, the cam 71 is rotated clockwise to release the locked state.

As shown in FIG. *7g*, the cam 71 is rotated substantially to a horizontal state and, upon releasing the depressing operation of the plunger 23 in this state, the plunger 23 is moved upwardly by the action of the spring 61.

In the initial stage of the upward movement, as shown in FIG. *7h*, the third control section 77 abuts against the side portion of the cam 71 to further rotate the cam 71. When the plunger 23 moves upwardly by this operated state, the side portion of the cam 71 is in sliding contact with the fourth control section 78, whereby the plunger 23 moves upwardly to the upper limit position, that is, to the position where the switch is operated OFF to return into the position shown by the FIG. *7a*.

As described above, the alternating mechanism 69 can maintain the ON state of the switch by one depressing operation of the push button unit 21 by way of the plunger 23 and can operate the switch to the OFF state by a further depressing operation.

In the foregoing embodiment, although the cam control 72 is defined in the wall surface of the plunger 23, the actuation member 62 of the plunger 23 may be formed broader in the lateral direction and the cam control portion 72 may be formed on the operation member 62 as another configuration.

(d) Description of the Receptacle Unit

The socket unit 24 comprises the socket base 65 as already described and a socket cover 79 joined to the upper surface of the socket base 65.

The socket cover 79 has an engaging structure formed at the upper surface thereof for engaging the element holder 39 of the illumination unit 22.

Specifically, engaging fingers 80, 80 are erected at the upper surface of the socket cover 79 at a predetermined distance from each other and the engaging fingers 80, 80 respectively have seizing grooves 81, 81, each opening at the upper ends thereof.

Further, protrusions 82, 82 are formed on the side of the element holder 39 of the illumination unit 22 at the positions opposite to the engaging fingers 80, 80. The protrusions 82, 82 are engaged and put between the seizing grooves 81, 81 of the engaging fingers 80, 80 when the illumination unit 22 is mounted to the upper surface of the socket cover 29, by which the illumination unit 22 is connected to the upper surface of the socket unit 24.

Further, insertion ports 83, 83 are formed in the socket cover 79 so as to penetrate the cover 79. The insertion ports 83, 83 are formed at the positions opposite to lead terminal 57 or 58 of the illumination element 54 when the illumination unit 22 is mounted to the upper surface of the socket cover 79 and allow the lead terminal 57 or 58 to pass therethrough.

Guide members 84, 84 are erected to the upper surface of the socket cover 79 and they function to guide the abutment of the returning spring 61.

As shown in FIG. 8 through FIG. 11, socket holes 85, 85 are formed in the upper surface of the socket base 65 and they are formed at the positions corresponding to the insertion ports 83, 83 of the socket cover 79.

The socket holes 85, 85 have lateral width capable of receiving the lead terminals 58 of the LED 56. The holes 85, 85 are formed with recesses 87, 87 at the hole walls 86, 86 respectively, and the recesses 87, 87 are formed vertically and engaged to a portion of the circumferential surface of the round rod type lead terminals 57, 57 of the lamp 55.

To the inside of the socket holes 85, 85 opposing the hole walls 86, 86, are inserted the free ends of the contact members 88, 88, and the contact members 88, 88 are bent at the middle portions thereof so as to provide a resiliency, and are in resilient contact with the respective lead terminals 57, 58.

By forming the recesses 87, 87 to the hole walls 86, 86, since the thickness is different between the lamp 55 and the lead terminals 57, 58 of the LED 56, by fitting a portion of the lead terminal 57 of the lamp 55 to the recesses 87, 87, the protruding amount of the lead terminal 57 is substantially equal with the thickness of the lead terminal 58 of the LED 56, whereby the resiliency of the contact member 88 is equally acted on both of the lead terminals 57, 58.

While the recess 87 is formed to the hole wall 86, the recess 87 may also be formed on the side of the contact member as another configuration.

Figure 10:
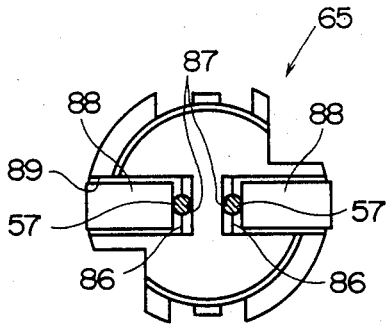
FIG. 10 is a plan view for the socket base when mounted with a lamp.
Figure 11:
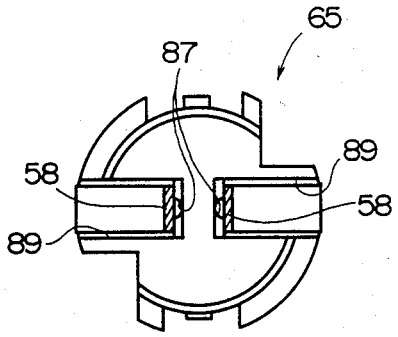
FIG. 11 is a plan view for the socket base when mounted with LED.
Figure 12:
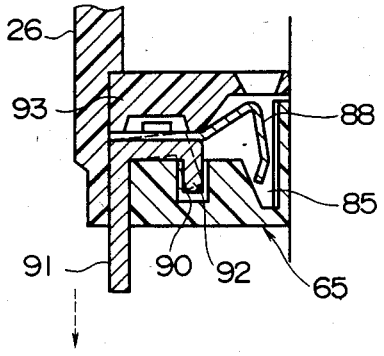
FIG. 12 is a vertical cross sectional view for a portion of the socket unit.

As also shown in FIGS. 10 through 12, grooves 89, 89 to be connected with the socket holes 85, 85 are formed to the socket base 65 toward the outer circumference, and engaging ports 90, 90 are formed at the intermediate positions between the grooves 89, 89.

The engaging ports 90, 90 accomodate the terminal engaging members, 92 formed by bending the upper ends of the connection terminals 91, 91, by which detachment of the connection terminals 91, 91 can be prevented even when the connection terminals 91, 91 are pulled downward.

To the flat portion at the upper ends of the connection terminals 91, 91, are fixed the base ends of the contact members 88, 88.

Further, joining members 93, 93 are formed at the peripheral edge of the socket cover 79 corresponding to the grooves 89, 89 and, when the joining members 93, 93 are fitted to the grooves 89, 89, the upper ends of the connection terminals 91, 91 are covered to obtain satisfactory insulation for the portion of the socket holes 85, 85.

At the same time, the joining position between the socket base 65 and the socket cover 79 is controlled by the engagement between the grooves 89, 89 and the joining members 93, 93.

Figure 13:
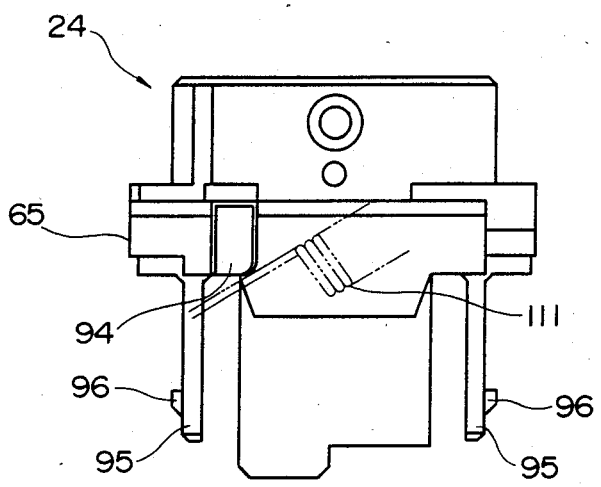
FIG. 13 is a side elevational view for the socket unit.

As shown also in FIG. 13, a control portion 94 is formed at the lower surface of the socket base 65, and the control portion 94 is acted on the switch unit 25 to be described later, the specific operation of which will be made clear in the later explanation for the switch unit 25.

Further, connection members 95, 95 are suspended from opposing positions at the circumferential edge of the socket base 65, and engaging fingers 96, 96 are formed respectively at the outer side of the lower ends of the connection members 95, 95. The engaging fingers 96, 96 are used for connecting the switch unit 25 as described later.

(e) Description of the Switch Unit

The switch unit 25 comprises a double-throw type switch mechanism, in which two switch mechanisms 98, 98 are constituted on a plane, and the switch mechanisms 98, 98 are actuated by the pair of operation members 62, 62 of the plunger 23 respectively.

Figure 14:
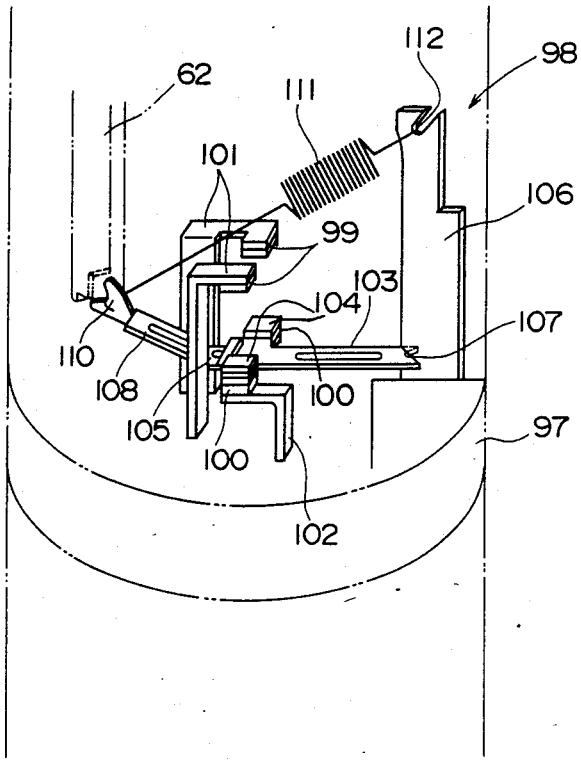
FIG. 14 is a perspective view for a switch mechanism.

The switch mechanism 98 shown in FIG. 14 denotes one set and the other set is constituted in a similar manner.

Switch mechanism 98 comprises a pair of left and right first terminals 101 and second terminals 102 having secured stationary contacts 99, 100 opposed to each other one above the other. The ends of terminals 101 and 102 extend through switch base 97, the terminals being fixed to the switch base.

A free end of a first movable member 103 is inserted between the stationary contacts 99, 100 and the free end has width sufficient the opposing faces of the stationary contacts 99, 99, 100, 100 situated at the left and right. Contacts 104 are secured to the upper and lower surfaces of the broad portion for contact with each of the contacts 99, 100.

An engaging protrusion 105 is disposed at the central portion on the free end of the first movable member, and the base end of the movable member is engaged to an engaging recess 107 formed to the lower portion of the protruding member 106 erected on the switch base 97.

The engaging protrusion 105 of the first movable member 103 is engaged with the engage hole 109 formed at one end of a second movable member 108 and the movable members 103, 108 are pivotable.

The second movable member 108 has formed at the other end thereof a protruding member 110 formed by bending erect a portion thereof, and the protruding member 110 is disposed to the switch operation portion and it is opposed in contact with the lower end of the operation member 62 of the plunger 23.

One end of a spring 111 is engaged to the protruding member 110 of the second movable member 108, and the other end of the spring 111 is engaged to the recess 112 formed at the upper end of another protruding member 106. The spring 111 resiliently biases the erected member 110 upwardly, and energizes the contact 104 of the first movable member 103 to press against the stationary contact 100 of the terminal 102 by way of the second movable member 108.

In the state where the contact 104 is in contact with the stationary contact 100 below, the switch function is kept at an OFF state.

When the erected member 110 is depressed by the operation member 62 of the plunger 23 from this state, the dead point of the spring 111 is exceeded due to the downward movement of the erected member 110, whereby the second movable member 108 is reversed and, due to the reversion, the contact 104 of the first movable member 103 moves upwardly to contact the stationary contact 99 of the first terminal 101 above, thereby switch to the on state.

As described above when the contact 104 and the stationary contacts 99, 100 are in contact with or separated from each other, there is no lateral slippage between the contacts which could cause abrasion between them. Further, the contacts are separated from or in contact with each other under a certain pressure of the spring 111 to attain a stable operation.

Post members 113, 113 are erected at the opposing positions around the peripheral edge of the upper surface of the switch base 97, and engaging holes 114, 114 are formed to the inside of the base of the post members 113, 113 respectively.

The engaging holes 114, 114 are engaged with the engaging fingers 96, 96 of the connection members 95, 95 suspended from the socket base 65 to connect them with each other.

When the socket base 65 is connected to the switch base 97 as described above, the upper surface of the switch mechanism 98 is covered with the socket base 65. The covered state is particularly effective upon assembling work for the switch. For instance, when the switch mechanism 98 is assembled and contained within the housing 26, each of the elements on the switch mechanism 98 can be prevented from contacting the opening edge of the housing 26 and disassembling.

Further, in the above-mentioned state, since the control section 94 formed to the socket base 65 is in contact with the upper surface of the spring which is left free to inhibit the swinging movement of the spring 111 each of the elements of the switch mechanism 98 can be prevented from dismantling due to the swing of the spring 111 during assembly.

The post members 113, 113 erected on the switch base 97 have grooves 115, 115 formed at the outer surface thereof corresponding to the suspending positions for the connection terminals 91, 91 of the socket unit 24 and capable of containing the connection terminals 91, 91.

In addition, gaps 116, 116 are formed between the grooves 115, 115 and the connection terminals 91, 91, and the gaps 116, 116 constitute effective insulation when the push button switch 20 is mounted to the switch socket as described later.

(f) Description of the Housing

The housing 26 as described above, has two securing means for mounting to a mounting panel 117.

Figure 15:
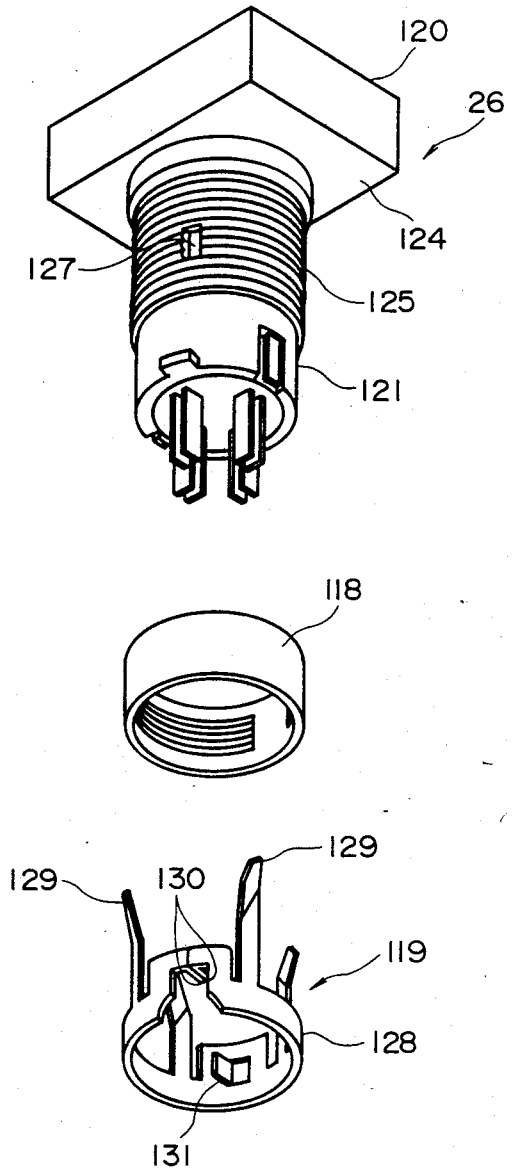
FIG. 15 is a perspective view for a housing mounting portion.
Figure 16:
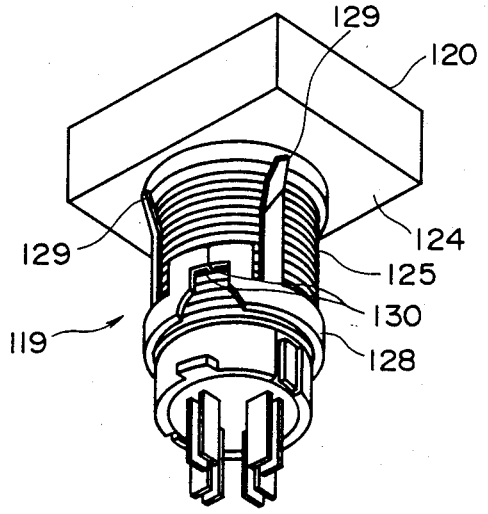
FIG. 16 is a perspective view for a housing mounted with a resilient member.
Figure 17:
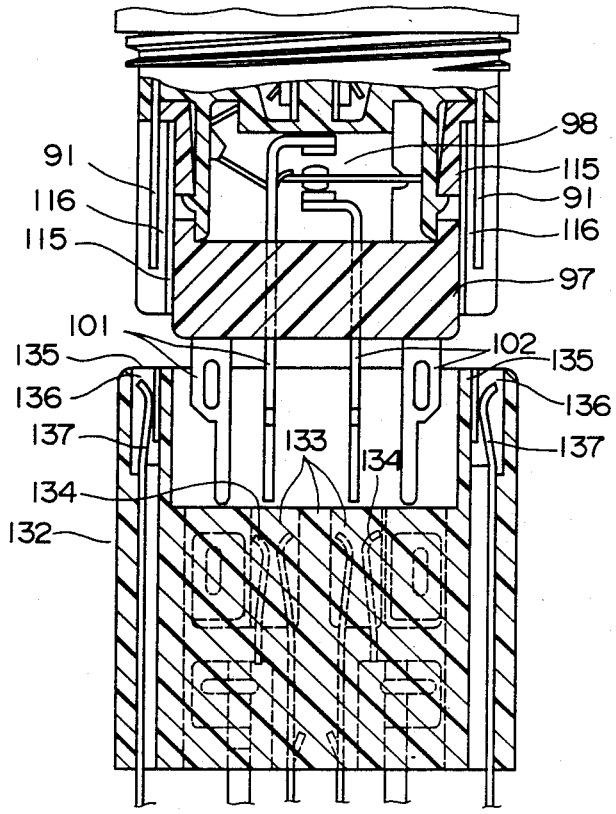
FIG. 17 is a vertical cross sectional view for a switch socket.
Figure 18:
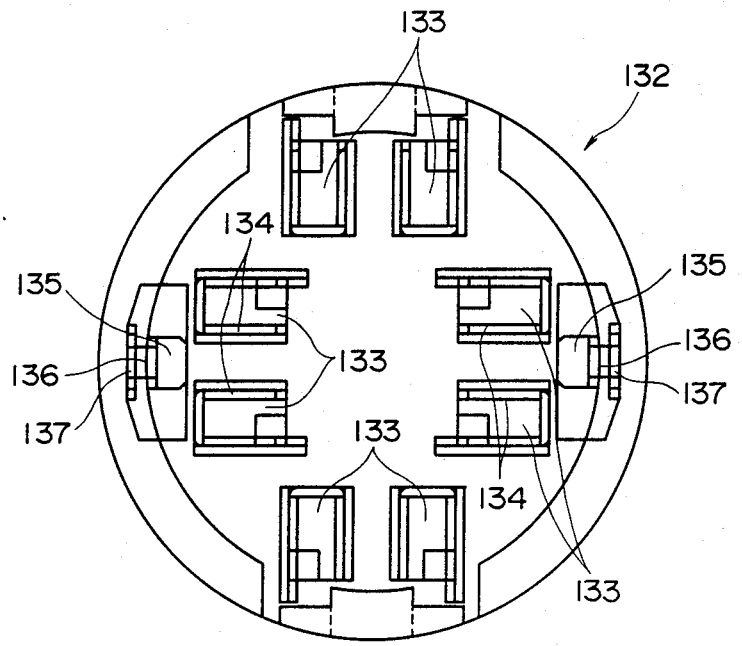
FIG. 18 is a plan view for the switch socket.
Figure 19:
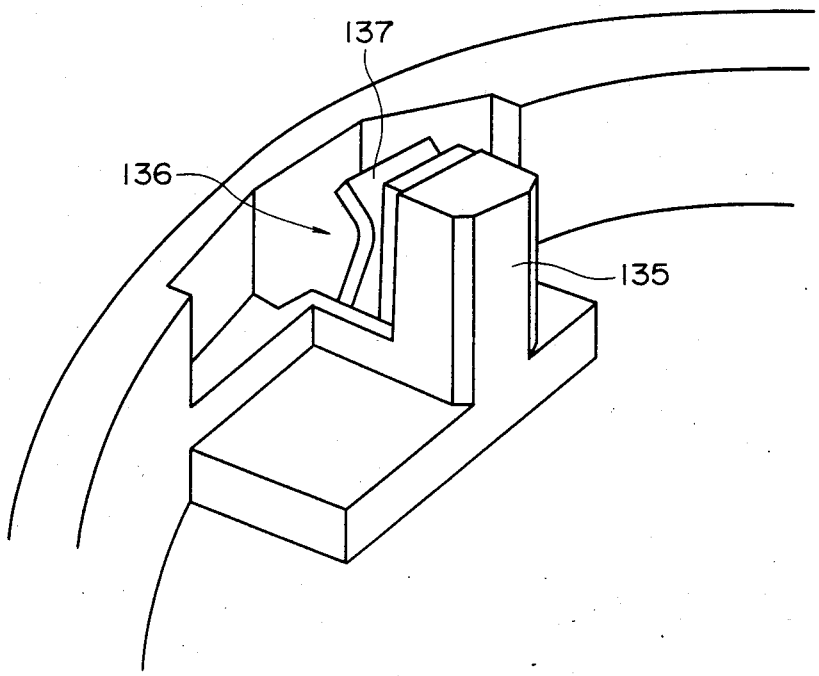
FIG. 19 is a perspective view for a portion of the switch socket.
Figure 20:
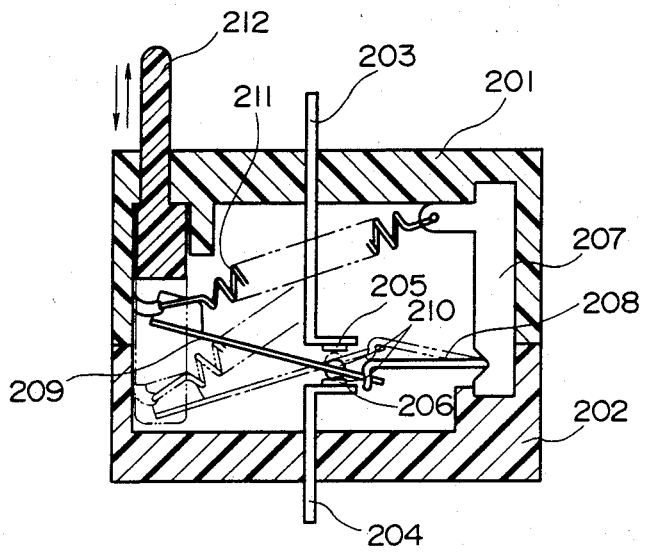
FIG.20 PRIOR ART
FIG. 20 is a vertical cross sectional view for a conventional switch.

As shown in FIGS. 15 and 16, one of the securing means is a securing nut 118 and the other is a securing resilient member 119.

The housing 26 described above has a rectangular portion 120 formed at the upper end thereof for housing the button unit 21 as described above, and a cylindrical portion 121 formed integrally with the central portion at the bottom of the rectangular portion 120.

To the inside of the cylindrical portion 121 as described above, are housed the illumination unit 22, plunger 23, receptacle unit 24 and switch unit 25 described previously.

Engaging holes 122, 122 are formed at the opposing positions on the lower end of the housing 26, and the engaging holes 122, 122 are engaged with the engaging fingers 123, 123 formed at the side of the switch base 97, thereby securing the switch unit 25 to the housing 26.

The lower surface of the rectangular portion 120 is formed as an engaging portion 124. Threads are formed around the outer circumferential surface at the upper portion of the cylindrical portion 121 for threading engagement with the nut 118. By inserting the cylindrical portion 121 through the opening 126 of a mounting panel 117 and screw-coupling the nut 118, the housing 26 can be mounted to the mounting panel 117 by putting the mounting panel 117 between the engaging portion 124 and the nut 118.

Engaging holes 127, 127 are formed at the opposing positions in the threaded portion 125 of the cylindrical portion 121 and the resilient member 119 as described above is engaged to the engaging holes 127, 127.

The resilient member 119 is formed with a resilient leaf spring material and comprises a band-like portion 128 formed in an annular shape and a plurality of engaging members 129, extending upwardly from the band-like portion 128.

The band-like portion 128 is separated at one position, by which the annular member can be extended. Lugs 130, 130 are formed on both joining ends of the band-like portion 128, and a lug 131 is erected to the inside at a position of the band-like portion 128 corresponding to the lug 130.

The lugs 130, 131 as described above are engaged to the engaging holes 127, 127 of the cylindrical portion 121 respectively by extending the band-like portion 128.

The engaging members 129 are bent at the upper ends thereof so as to turn outwardly and the bent portion creates outward biasing force.

As described above, when the housing 26 mounted with the resilient member 119 to the cylindrical portion 121 is inserted to the opening 126 of the mounting panel 117 till it is abutted against the engaging portion 124, the housing can be secured by the engaging members 129 of the resilient member 119 that urges the opening 126 outwardly.

As described above, the mounting of the housing 26 includes two modes, that is, by means of the nut 118 and the resilient member 119, which can be used selectively.

(g) Description of the Switch Receptacle

The illumination type push button switch 20 having thus been constituted is mounted to a switch socket 132 to be described below.

The switch socket 132 is formed into a cylindrical shape, in which socket holes 133 are formed at the positions on the upper plane corresponding to the first and second terminals 101, 102 of the switch unit 25 and contact members 134 are contained to the inside of the socket holes 133 with the contact members 134 being electrically connected respectively with the terminals 101, 102.

Further, protrusions 135, 135 are erected to the switch receptacle 132 at the positions corresponding to the connection terminals 91, 91 of the socket unit 24, and the protrusions 135, 135 are inserted in the grooves 115, 115 formed to the post members 113, 113 of the switch base 97 and inserted in the gaps 116, 116 between the grooves 115, 115 and the connection terminals 91, 91.

Then, socket holes 136, 136 are formed to the outer side of the protrusions 135, 135 and contact members 137, 137 are contained within the socket holes 136, 136 and the contact members 137, 137 are electrically connected with the connection terminals 91, 91.

In the switch socket 132 having thus been constituted, the creeping distance between the connection terminals 91, 91 and other terminals 101, 102 is increased to improve the insulation performance by the insertion of the protrusions 135, 135 between the connection terminals 91, 91 and other terminals 101, 102, when the illumination type push button switch 20 is mounted.

In the illumination type push button switch 20 and the switch socket 132 having thus been constituted, improvements have been obtained for the switch operation characteristics, the workability in the assembling of each of the elements and, further, the insulation performance. However, this invention is no way limited only to the structure of the aforementioned embodiment but it may be constituted with modifications based on the spirit of this invention.

We claim:

1. A push button switch, comprising a switch unit which comprises:

a base;

at least one first terminal and at least one second terminal, said terminals extending essentially vertically from said base;

2. A switch as claimed in claim 24, further comprising:

a housing;

an upwardly biased plunger which is movable over a predetermined range located within the housing, said plunger having an upper surface and means for moving said second protruding member vertically; and a push button unit located within the housing and connected to the upper surface of the plunger and capable of depressing the plunger over said predetermined range.

3. A switch as claimed in claim 2, wherein said switch unit has an upper portion and a lower lateral edge, and said push button unit has an upper surface which defines an illumination face, and said switch further comprises:

an illumination unit located within the housing having an illumination element for illuminating the illumination face, said illumination element being housed within the push button unit, said illumination unit including means for allowing relative movement between the illumination unit and the push button unit;

a socket unit housed within the plunger which is connected to the illumination element, said socket unit being secured to the upper portion of the switch unit; and connection members suspended at opposing positions on the lower lateral edge of the socket unit, said connection members being secured to the base of the switch unit.

4. A switch as claimed in claim 3, wherein the plunger has a window formed in a side wall and the socket unit further comprises a rectangular cam rotatably mounted thereto within the window, said cam having engaging grooves formed in two opposing sides thereof, said window defining first, second, third and fourth control sections which control the rotation of the cam when the plunger is depresses over the predetermined range, wherein when the plunger is depressed, the plunger moves from a non-depressed position to a depressed position, and the cam is rotated so as to hold the plunger in the depressed position, and when the plunger is depressed again, the cam is rotated so as to allow the plunger to return to the non-depressed position.

5. A switch as claimed in claim 4, wherein the cam has an end and the first control section contacts the end of the cam to cause the cam to rotate in a predetermined direction when depression of the plunger is begun, the second control section engages one of the engaging grooves of the cam to hold the cam at a predetermined angle when the plunger is further depressed, the third control section engages the opposing engaging groove of the cam when the plunger is fully depressed, and the fourth control section prevents the cam from further rotation in the predetermined direction, thereby allowing the cam to hold the plunger in the depressed position.

6. A switch as claimed in claim 3, wherein the plunger has an opening and a portion of the illumination unit is movable within the opening in the plunger, the switch further comprising means for allowing the illumination unit to be inserted in the plunger only when the illumination unit and plunger are located in a predetermined spacial relationship.

7. A switch as claimed in claim 6, wherein the illumination unit has a circumferential side wall, and said means for allowing the illumination unit to be inserted in the plunger comprises a plurality of protrusions located on the circumferential side wall of the illumination unit and a plurality of grooves located in the opening of the plunger.

8. A switch as claimed in claim 7, wherein said means for allowing the illumination unit to be inserted in the plunger further comprises a plurality of abutting portions located in the opening of the plunger for preventing insertion of the illumination unit into the opening of the plunger when the illumination unit is rotated 180° from the predetermined spacial relationship, thereby preventing the movement of the plunger over the predetermined range.

9. A switch as claimed in claim 3, wherein said push button unit comprises a reflecting member, said reflecting member having a lower portion which has opposing peripheral portions, an opening at the lower portion thereof and two supports protruding downwardly from the opposing peripheral portions of said lower portion, each of said supports having a groove therethrough extending vertically, and wherein the illumination unit comprises a pair of protrusions engagable with said grooves.

10. A switch as claimed in claim 2, further comprising an annular flexible seal having an outer peripheral edge and an inner peripheral edge, wherein the inner peripheral edge is sandwiched between the push button unit and the plunger, and the outer peripheral edge is secured to the housing.

11. A switch as claimed in claim 3, wherein said socket unit comprises a socket base having an upper surface and a socket cover joined to the upper surface of the socket base, said socket cover having insertion ports formed therethrough for allowing lead terminals of the illumination element to pass therethrough, said socket base having socket holes for receiving the lead terminals.

12. A switch as claimed in claim 11, wherein the socket base further comprises contact members located in the socket holes for contacting the lead terminals, the socket holes having recesses for engaging a portion of a circumferential surface of cylindrical lead terminals formed in walls adjacent the contact members.

13. A switch as claimed in claim 11, wherein the socket base has an upper surface and further comprises engaging ports located in the upper surface thereof, connection terminals, and contact members located in the socket holes for contacting the lead terminals and connection terminals, said connection terminals having terminal engaging members for engaging the engaging ports.

14. A switch as claimed in claim 1, wherein said spring has an upper surface, and further comprising a control portion which acts on the upper surface of the spring when the movable contact is held against the second stationary contact to prevent upward movement of the spring.

15. A switch as claimed in claim 14, wherein the switch unit has an upper portion, and further comprising a socket unit secured to the upper portion of the switch unit, said socket unit having a lower surface, wherein said control portion is located on the lower surface of the socket unit.

16. A switch as claimed in claim 1, wherein the switch unit comprises a pair of first terminals with a pair of first stationary contacts attached thereto and spaced apart from each other, said pair of first stationary contacts being located in a first horizontal plane, and a pair of second terminals with a pair of second stationary contacts attached thereto and spaced apart from each other, said pair of second stationary contacts being located in a second horizontal plane parallel to said first horizontal plane.

17. A switch as claimed in claim 1, wherein the switch unit comprises a plurality of first terminals having a plurality of first stationary contacts attached thereto and spaced apart from each other, said plurality of first stationary contacts being located in a first horizontal plane, and a plurality of second terminals having a plurality of second stationary contacts attached thereto and spaced apart from each other, said plurality of second stationary contacts being located in a second horizontal plane parallel to said first horizontal plane, wherein said first movable member has a plurality of movable contacts attached to lateral sides of the free end thereof, the number of movable contacts being equal to the number of first stationary contacts plus the number of second stationary contacts.

18. A switch as claimed in claim 2, wherein said plunger has a lower peripheral edge and said means for moving said second protruding member comprises an operation member extending downwardly from the lower peripheral edge of the plunger, the operation member having an end which is engagable with the second protruding member.

19. A switch as claimed in claim 2, wherein said housing has an outer surface and an engaging portion located on the outer surface thereof, said engaging portion having a lower portion which is threaded, said switch further comprising a switch securing nut engagable with the threads on the engaging portion, engaging holes formed in the housing, and a switch-securing resilient member engagable with the engaging holes.

* * * * *

UNITED STATES PATENT AND TRADEMARK OFFICE

CERTIFICATE OF CORRECTION

PATENT NO. : 4,908,485

DATED : March 13, 1990

INVENTOR(S) : Sueaki Honda et al.

It is certified that error appears in the above-identified patent and that said Letters Patent is hereby corrected as shown below:

Claim 1 should read:

1. A push button switch, comprising a switch unit which comprises:

a base;

at least one first terminal and at least one second terminal, said terminals extending essentially vertically from said base;

a first stationary contact attached to each of said at least one first terminal and a second stationary contact attached to each of said at least one second terminal, the first stationary contact being spaced vertically from the second stationary contact;

a first protruding member fixed to and extending from the base;

a first movable member having two opposing ends, one end of which is coupled to the first protruding member, the opposing end of which is free, said free end having a movable contact attached thereto;

UNITED STATES PATENT AND TRADEMARK OFFICE

CERTIFICATE OF CORRECTION

PATENT NO. : 4,908,485

DATED : March 13, 1990

INVENTOR(S) : Sueaki Honda et al.

It is certified that error appears in the above-identified patent and that said Letters Patent is hereby corrected as shown below:

a second movable member having two opposing ends, one end of which is pivotably connected to the free end of the first movable member, the opposing end of which is free;

a spring connected to the free end of the second movable member, said spring acting on the second movable member so as to urge the movable contact against the second stationary contact;

a second protruding member fixedly attached to the free end of the second movable member, said second protruding member being movable vertically so as to move the movable contact vertically to contact the first stationary contact.

Claim 2 should be dependent on claim 1, not claim 24.

Signed and Sealed this

Third Day of August, 1999

*Attest:*

Q. TODD DICKINSON

*Attesting Officer*

*Acting Commissioner of Patents and Trademarks*